US006918164B2

(12) United States Patent
Bathelier

(10) Patent No.: US 6,918,164 B2
(45) Date of Patent: Jul. 19, 2005

(54) METHOD AND DEVICE FOR MAKING MESHED TEXTILE PRODUCTS DIRECTLY FROM FIBRES AND/OR FILAMENTS AND RESULTING PRODUCTS

(75) Inventor: Xavier Bathelier, Saint-Pierremont (FR)

(73) Assignee: Trakett Sommer S.A., Nanterre Cedex (FR)

( * ) Notice: Subject to any disclaimer, the term of this patent is extended or adjusted under 35 U.S.C. 154(b) by 0 days.

(21) Appl. No.: 10/483,208

(22) PCT Filed: Jul. 16, 2002

(86) PCT No.: PCT/EP02/07949

§ 371 (c)(1),
(2), (4) Date: Jan. 7, 2004

(87) PCT Pub. No.: WO03/008686

PCT Pub. Date: Jan. 30, 2003

(65) Prior Publication Data

US 2004/0231369 A1 Nov. 25, 2004

(30) Foreign Application Priority Data

Jul. 18, 2001 (EP) ..... 01870159
Dec. 20, 2001 (EP) ..... 01870283

(51) Int. Cl.[7] ..... D04H 1/74
(52) U.S. Cl. ..... 28/107
(58) Field of Search ..... 28/107, 108, 109, 28/110, 113, 114; 66/9 R, 61, 83, 80, 85 R; 156/435, 437, 441

(56) References Cited

U.S. PATENT DOCUMENTS 5,239,734 A 8/1993 Bathelier et al. ..... 28/107
5,867,880 A * 2/1999 Bathelier et al. ..... 28/107
6,012,205 A * 1/2000 Bathelier et al. ..... 28/107
6,432,234 B1 8/2002 Bathelier ..... 156/72
6,519,820 B1 2/2003 Bathelier ..... 28/107
6,523,234 B1 2/2003 Bathelier ..... 28/107
6,817,396 B2 * 11/2004 Bathelier ..... 156/435

FOREIGN PATENT DOCUMENTS

| | | |
|---|---|---|
| DE | 1 660 779 | 2/1971 |
| DE | 42 35 858 A 1 | 3/1994 |
| DE | 42 39 469 A 1 | 5/1994 |
| WO | WO 91/00382 | 1/1991 |
| WO | WO 96/10667 | 4/1996 |
| WO | WO 00/60155 | 10/2000 |

* cited by examiner

*Primary Examiner*—Danny Worrell
(74) *Attorney, Agent, or Firm*—Alix, Yale & Ristas, LLP

(57) ABSTRACT

The invention concerns a method for making meshed textile products from fibres and/or filaments moving past in the form of a web. The method involves subjecting the fibres and/or filaments to transverse looping with joint drawing by means of an assembly including a set of interpenetrating identical looping discs spaced apart and located on a common transverse axis with a set of identical looping elements, the looping discs having on their periphery relatively spaced apart teeth; accumulating the fibres and/or filaments in the form of at least a crinkled pseudo-yarn of a certain length wherein the fibres and/or filaments are paralleled, the accumulation of the fibres and/or filaments being carried out against the slope of a tooth opposite the input of the web; transferring into the eye of the set of needles over the entire length of the pseudo-yarn; and carrying out in standard manner another fabric course using the pseudo-yarn transferred into the eye of the needles.

15 Claims, 9 Drawing Sheets

METHOD AND DEVICE FOR MAKING MESHED TEXTILE PRODUCTS DIRECTLY FROM FIBRES AND/OR FILAMENTS AND RESULTING PRODUCTS

CROSS-REFERENCE TO RELATED APPLICATIONS

This is the National Stage of International Application No. PCT/EP02/07949 filed Jul. 16, 2002.

SUBJECT OF THE PRESENT INVENTION

The present invention relates to an improved method for making meshed textile products directly from fibres and filaments.

The present invention also relates to a device for implementing the method and extends to meshed products resulting from the said method and/or produced by the said device.

The present invention also relates to mesh type products with fine mesh and/or appearing in velvet form.

SUMMARY OF THE PRIOR ART

The standard methods for making meshed products with fine mesh using the usual manufacturing techniques, which are techniques with gathered stitches or techniques with cast stitches, are known.

Moreover, the standard methods for preparing velvet, particularly in the case of products with gathered stitches, are either carried out by the use of an extra yarn or by the use of a card ribbon.

In the first case, two types of yarns are used, which are gathered simultaneously by the same needle. The first yarn will form a normal stocking stitch passing directly from one needle to the other, while the second will have to loop before meeting the next needle, passing above a special plate (looping element). The first yarn ensures the plane cohesion of the product; the second forms rows of small loops which, once clipped, will constitute the velvet.

In the second case, the process begins by generating a product of the "false fur" type. This product is made in the following manner: the needles, before seizing the yarn which will make a classic stocking stitch, "tap" into the flexible covering of a mini drum of the card on which is located the web (coming from a ribbon) and pull along a "tuft" of fibres (the fibres not seized will be drawn up and possibly recycled). This tuft is anchored in the structure of the stocking stitch just as if it were a yarn. This false fur is then clipped to generate the velvet. As the length of the fibres in a tuft is random, the losses due to the clipping are great, much more than in the case of velvet generated by small loops.

The present invention relates essentially to the preparation of products obtained by the technique known as the "verticalization technique" developed by the Applicant.

This technique is described in European patent EP-A-0 479 880 and directly permits, starting from fibres and/or filaments moving in the form of a web, the preparation of textile products and more particularly of floor and/or wall coverings of moquette type.

The verticalization technique described consists in making the fibres and/or filaments undergo "transverse looping" accompanied by "drawing" and in obtaining an accumulation of the fibres and/or filaments in the form of a "pseudo-yarn" in which the fibres and/or filaments are parallelized.

In these documents, it is described that the transverse looping accompanied by drawing is carried out for each individual fibre or filament by means of rotating looping fingers or discs, spaced apart and arranged on an axis which is transverse in relation to the forward direction of the web, and between which are arranged looping fingers. In this manner, each fibre or filament is in principle involved in at least one looping so as to form a torsionless pseudo-yarn obtained by the accumulation of the various correctly parallelized elementary fibres and/or filaments. This torsionless pseudo-yarn formed by the parallelized fibres and/or filaments may either be manipulated by needles of the tufting needle type and be taken to a substrate with a view to making moquettes, as described in detail in publication EP-A-0 479 880, or be pulled along by meshing needles, as described in detail in publication EP-A-0 783 608, or alternatively be used to make products of the lapped-bonded type as described in detail in publication EP-A-0 960 227.

Document WO 96/10667 (downstream verticalization) describes the manner for making meshed products which come into the category of knitted products with gathered stitches, starting from fibres in the form of an orientated web. A set of discs fitted on their periphery with a network of fine teeth interpenetrating an assembly of looping fingers cooperate to pull along and condense the web against an assembly of gathering and transfer means to create a "pseudo-yarn" of crinkled form. These gathering and transfer means are formed by plates which each appear individually in the prolongation of the looping fingers.

This pseudo-yarn will then be transported by these plates driven with a rectilinear motion up to meshing needles which will form the knitting row after row.

A pseudo-yarn is therefore formed by a certain "slice" of condensed web whose length in the forward direction is called the "accumulation length".

If:

Pv denotes the weight of the web,

Pp denotes the weight of the knitting,

La denotes the accumulation length

Lt denotes the height of the mesh, conservation of the flows enables us to write that:

$$PvLa=PpLt.$$

Consequently, for a given product, the accumulation length will be proportionately greater the lower the weight of the web.

Certain fibres that are "astride" two consecutive slices will therefore participate in two successive yarns and in two successive rows of meshes. Such fibres are called interfering fibres. The percentage of these fibres varies according to the following parameters: the length of the fibres, the mean angle of orientation of the fibres in the web, and the accumulation length (and therefore the weight of the web).

These fibres remain positioned in the plane of the knitting and will provide advantageous properties such as run resistance, dynamometric characteristics of anisotropy, better resistance to punching, etc.

This concept described in this patent allows high quality stocking stitch to be made but does not permit:

the preparation of fine gauge knitting (less than 1/12 of an inch) since, on the one hand, discs with continuous fine toothing are not aggressive enough to make the yarn pass in formation behind the lug of the transfer plate (the play between disc and plate becomes too-small), and, on the other hand, the transfer plate would impede any beater plates, which are essential for the formation of this range of knitwear;

the preparation of small loops on the reverse side of the knitting (on the mesh base side) since, the transfer plates being permanently present at the end of the looping fingers, the interfering fibres cannot develop in the third dimension. The existence of such small loops would nevertheless be extremely advantageous since these small loops would make it possible, after shaving, to obtain a velvet that finds numerous applications, particularly in the motor vehicle sector and in cladding.

Document WO 00/60155, although considering the field of tufting, describes a new logic for formation of pseudo-yarn.

The said document describes the use of discs that are fitted with relatively widely spaced large teeth (this means that the distance between two consecutive teeth is at least three times the width of a tooth) between which accumulate the fibres pulled along by a first set of discs. The needles, which are tufting needles, gather the pseudo-yarn by penetrating between the compression discs, with the large teeth pushing the pseudo-yarn behind the eye of the tufting needles at the moment when they are at their top dead point.

Thus, it had been found that when the web was orientated with a value very close to the theoretical angle, the use of discs with fine, continuous teeth was not necessary for condensing the web and forming the yarn. The forces developed being very small, it is sufficient for the web to be "pricked" by a few large teeth, even very widely spaced teeth, for the logic of looping, drawing and condensation to be respected and lead to the preparation of a pseudo-yarn.

However, applying the logic described in document WO 00/61153 to the logic described in the Applicant's patent WO 96/10667 would have led to the production of a device comprising large-toothed discs between which are arranged the looping fingers and the gathering and transfer plates.

This solution would have been unsatisfactory for preparing the required products, in particular products of the meshed type with fine mesh and meshed products of velvet type.

Finally, it should be noted that the Applicant also proposed a device permitting a precise orientation of the web, and which formed the subject of a patent application published under No WO 01/04404. If an attempt was made to operate according to this logic with fibres orientated by another means, even if only 20° above the theoretical value, it would not be possible to pull them along uniformly and the discs would function like veritable choppers.

Aims of the Invention

The present invention is directed towards proposing a method and a device based essentially on the "verticalization" technique, which permit the preparation of meshed products and in particular meshed products with fine or even very fine mesh, i.e. made with a device having a gauge of less than 1/18 of an inch, i.e. less than 1.4 mm.

The present invention is also directed towards proposing a method and a device for making velvet, possibly very clipped, or products of the suede type.

The present invention is also directed towards enabling products such as those described above to be made via a method of markedly improved efficiency compared with those of the prior art.

Main Characteristic Elements

The present invention relates to a method for making meshed textile products from fibres and/or filaments moving along in the form of a web, in which:

the fibres and/or filaments are made to undergo transverse looping accompanied by drawing with the aid of an assembly formed by the interpenetration of a set of identical looping discs spaced apart and located on a common transverse axis with a set of identical looping elements, the looping discs having on their perimeter relatively well-spaced teeth, the fibres and/or filaments are accumulated in the form of at least one crinkled pseudo-yarn of a certain length in which the fibres and/or filaments are parallelized, the pseudo-yarn is transferred over its entire length and simultaneously directly into the eye of a set of meshing needles, a new row of meshes is made in a conventional manner with the aid of the pseudo-yarn transferred into the eye of the needles.

Advantageously, the meshing needles carry out the same movement simultaneously to receive the pseudo-yarn obtained by accumulation of the fibres and/or filaments. The passage of the pseudo-yarn thus created towards the open eye of the meshing needles is carried out when they are in the top dead point position.

According to a particularly preferred embodiment, the accumulation of the said fibres and/or filaments takes place against the slope of the teeth preceding the set of looping discs opposite the arrival of a web. This accumulation may in addition be favoured by the presence of a set of blocking means that prevent the fibres and/or filaments from continuing their course with the disc.

Each blocking means is placed in the prolongation of a looping element, such as the looping finger.

By way of an example, a blocking means may either be a bent strip of width corresponding for example to the thickness of the discs, i.e. of the order of −0.1 mm and of thickness between 0.2 and 2 mm, maintained at the opposite end on a fixed support and forming a spring, or a strip of different form on a mobile support whose control will determine the percentage of interfering fibres.

Specifically, this control makes it possible to act on the time of presence of such blocking means and their arrangement more or less close to the looping elements, and will generate depending on the case an adequate percentage of fibres that will serve as interfering fibres.

Thus, these blocking means may with the aid of a control be arranged more or less in the immediate vicinity of the top dead point of the meshing needles, which will act directly on the percentage of fibres serving as interfering fibres.

According to another embodiment, this accumulation of the said fibres and/or filaments may even take place in the absence of any blocking means and will therefore take place over a distance comprised between two successive teeth, for the purpose of creating excess matter on the reverse side of the product formed by interfering fibres.

In addition, the rotational speed of the looping discs is synchronized with those of the meshing needles, so that, by means of a differential, the discs advance by an $X^{th}$ of a turn per movement of the needles, X being the number of teeth.

Another subject of the present invention lies in the device for making meshed textile products from fibres and/or filaments moving along in the form of a web, characterized in that it comprises a set of identical rotating looping discs, spaced apart and located on a common transverse axis, interpenetrating with a set of identical looping elements, such as looping fingers, the looping discs having on their periphery relatively well-spaced teeth.

The expression "relatively well-spaced teeth" means the presence of a whole number of teeth regularly spaced on the periphery of the looping discs, the distance between two successive teeth equalling at least three times the height of the said teeth.

The device also comprises a set of meshing needles that are arranged between the rotating looping discs and in the prolongation of the looping elements such as the looping fingers.

According to a particularly advantageous characteristic of the present invention, blocking means, which are possibly positively actuated, are arranged in the prolongation of the looping elements such as the looping fingers.

The present invention also relates to a meshed textile product with fine meshing. Usually, meshed products are defined by the gauge of the device for preparing the said meshed product. The term "fine meshing" means a device for making such products with a gauge of less than 1/18 of an inch, i.e. less than 1.4 mm. It should be noted that the meshed product will have a mesh corresponding to the gauge to within about 10%.

According to an important characteristic of the invention, these products have a network of interfering fibres and/or filaments extending in both directions.

The present invention also relates to a meshed textile product having a network of interfering fibres and/or filaments extending in both directions in relation to the forward direction, with a content of interfering fibres and/or filaments of greater than 10% and preferably greater than 30%.

More precisely, the present invention relates to a meshed textile product that is in the form of velvet and whose content of interfering fibres and/or filaments is greater than 30% and preferably greater than 60%.

DESCRIPTION OF SEVERAL PREFERRED EMBODIMENTS OF THE INVENTION

The present invention will be described in detail with reference to the figures, in which essentially two embodiments are shown for making on the one hand a meshed product with fine or very fine mesh and having a small percentage of interfering fibres, and on the other hand a meshed product in stocking stitch form, possibly with fine or very fine mesh, but having a high percentage of interfering fibres on the reverse side of the product, with the aim of forming a velvet product.

Figure 1:
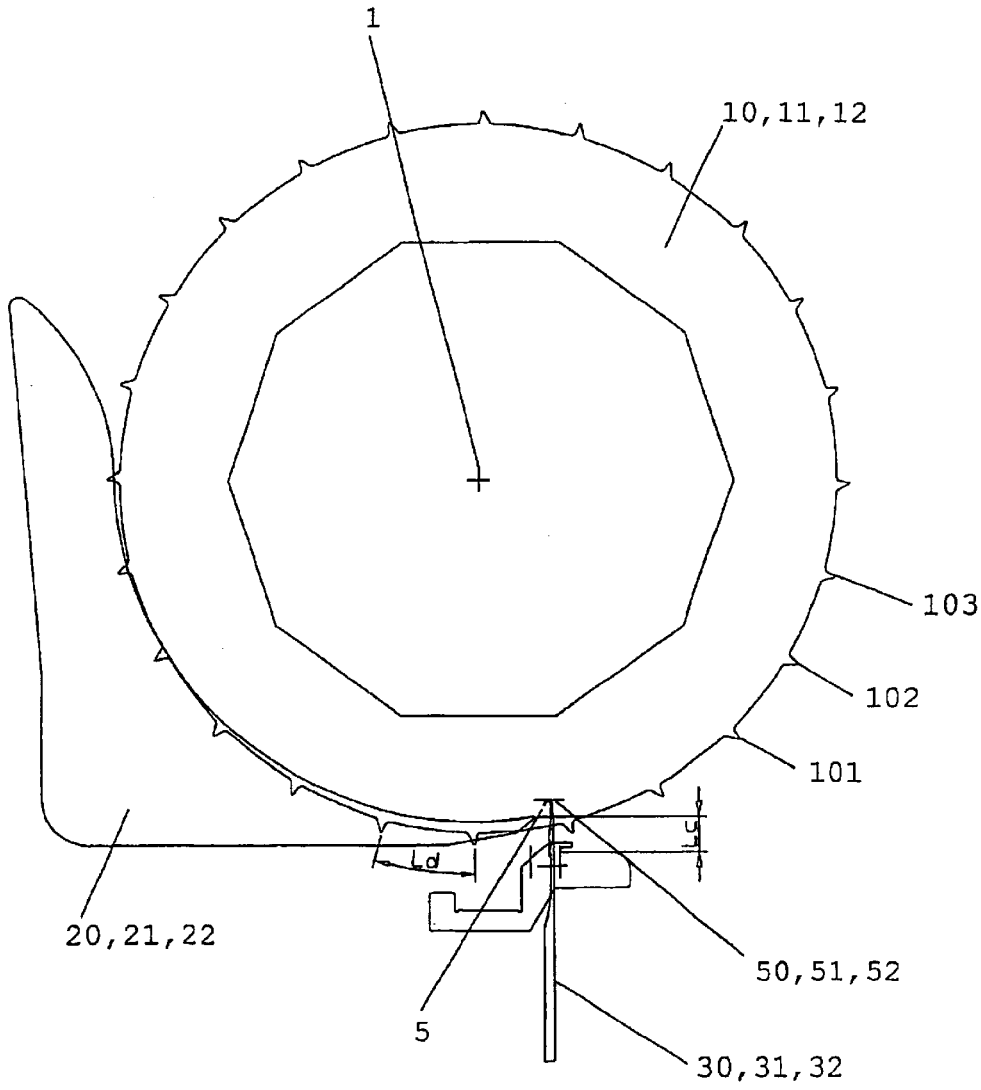
FIG. 1 describes a cross sectional view of the device according to the present invention intended for implementing the method.

FIG. 1 shows the positioning of the various members for making a device according to the present invention.

It is observed that only one set of identical discs arranged regularly on an axis and interpenetrating with a set of looping fingers will permit at the same time the formation of the pseudo-yarn by accumulation and the transfer of this pseudo-yarn into the eye of the meshing needles.

It is observed that the device resides essentially in the interpenetration of a set of identical looping discs 10, 11, 12, . . . located on a common transverse axis 01 with a set of looping fingers 20, 21, 22, . . . in the prolongation of which are arranged meshing needles 30, 31, 32.

The various looping discs 10, 11, 12 bear regularly, on their periphery, teeth 101, 102, 103, . . . 10X, where X is the number of teeth per disc. The meshing needles 30, 31, 32 perform a to-and-fro motion between beating plates 40, 41, 42.

The rotational speed of the looping discs is a uniform speed and is synchronized with that of the meshing needles 30, 31, 32 so that, by means of a differential, the discs advance by an $X^{th}$ of a turn per movement of the needles, X being the number of teeth.

Description of the Formation of a Meshed Product with Fine Mesh

The preparation of such a product is described in detail with the aid of FIGS. 2*a* to 2*f* which break down the movement of the different phases of the method for obtaining such a product.

FIG. 2*a:*

The needles penetrate between the discs, lifting the blocking means. From this moment, the needles will take over from the blocking means as regards the accumulation of the fibres, and therefore the formation of the pseudo-yarn (the fibres are parallel again by virtue of the orientation of the web).

FIG. 2*b:*

The needles have reached their top dead point. The fibres continue to accumulate. The tooth will begin to push the pseudo-yarn in the form of a loop to make it pass behind the needles.

FIG. 2*c:*

The needles have started their descent and are leaving the discs. As from this moment, the fibres which will continue to be delivered by the discs will be accumulated against the blocking means. A small quantity of fibres will nevertheless be drawn between the end of the looping fingers and the eye of the needles: these are the interfering fibres.

FIG. 2*d:*

The needles have reached their bottom dead point. They "beat down" the pseudo-yarn between the beat-down plates in a rear position thus forming a mesh. The blocking means are "locked" in their bottom position and thus continue to stop the fibres still delivered by the discs.

FIG. 2*e:*

The needles are still at the bottom dead point. The plates advance to push the preceding meshes and thus avoid the needles penetrating them again as they go up.

FIG. 2*f:*

The needles have started their ascent. The plates, still in the advanced position, prevent the knitting from going up with the needles. The needles prepare to raise the blocking means, which have accumulated a large part of the fibres constituting the pseudo-yarn that will be used to form the next rows of mesh. The interfering fibres form a small loop on the reverse side of the product.

FIG. 2*g:*

Figure 2B:
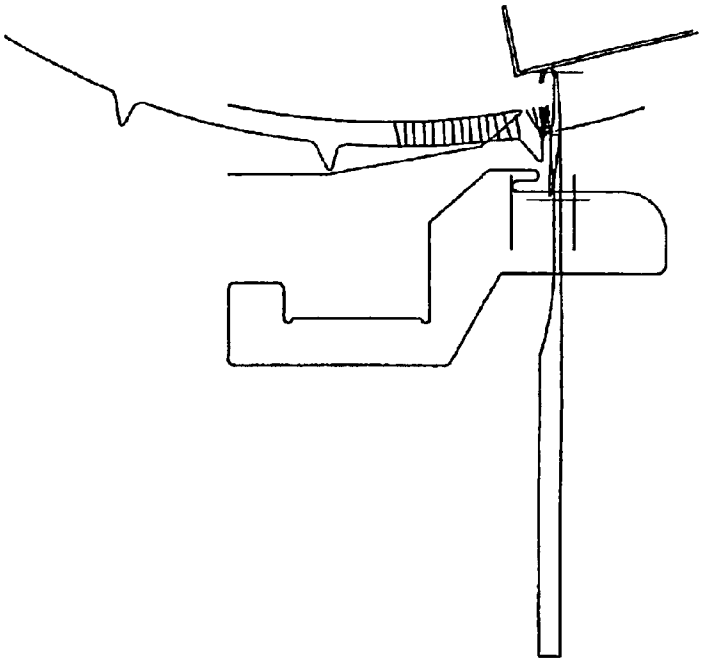
FIGS. 2*a* to 2*h* describe the complete cycle for making a meshed product according to a first preferred embodiment and forming a meshed product with fine mesh.
Figure 2A:
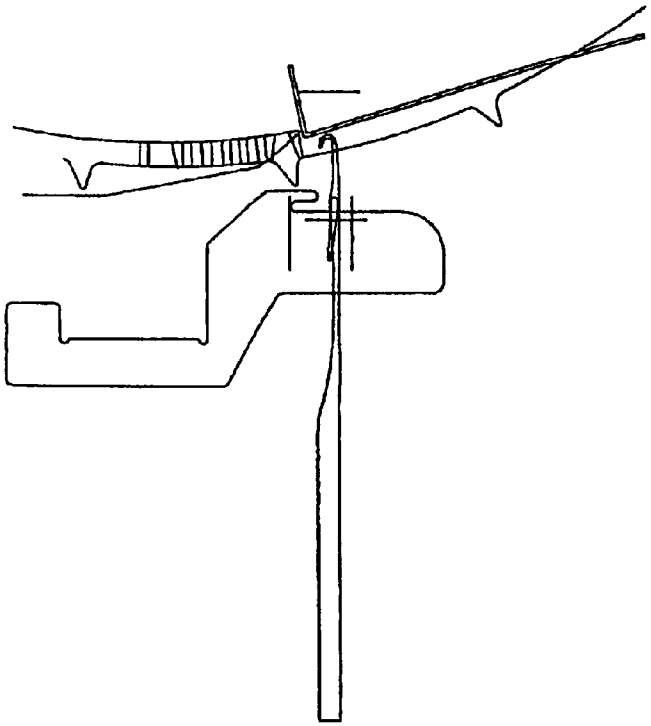
Figure 2D:
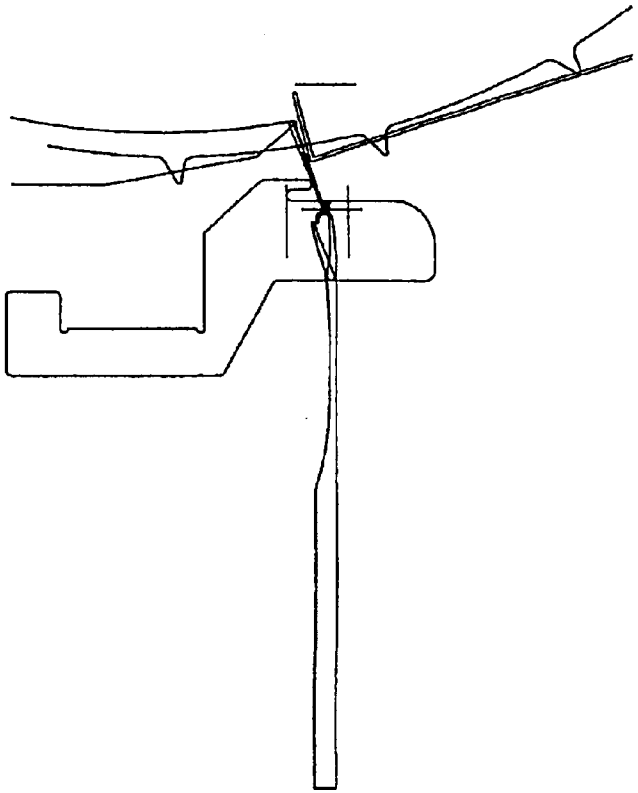

The phase of FIG. 2*b* is found again. The new pseudo-yarn has been created. Among the fibres that form it are interfering fibres participating in the small loop whose formation we are in process of describing, and interfering fibres which will participate in the next small loop.

FIG. 2*h:*

Figure 2C:
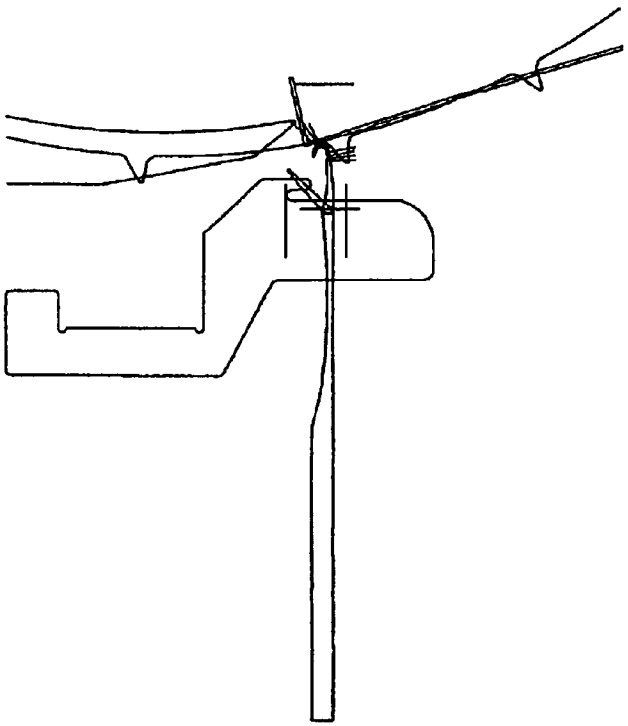
Figure 2F:
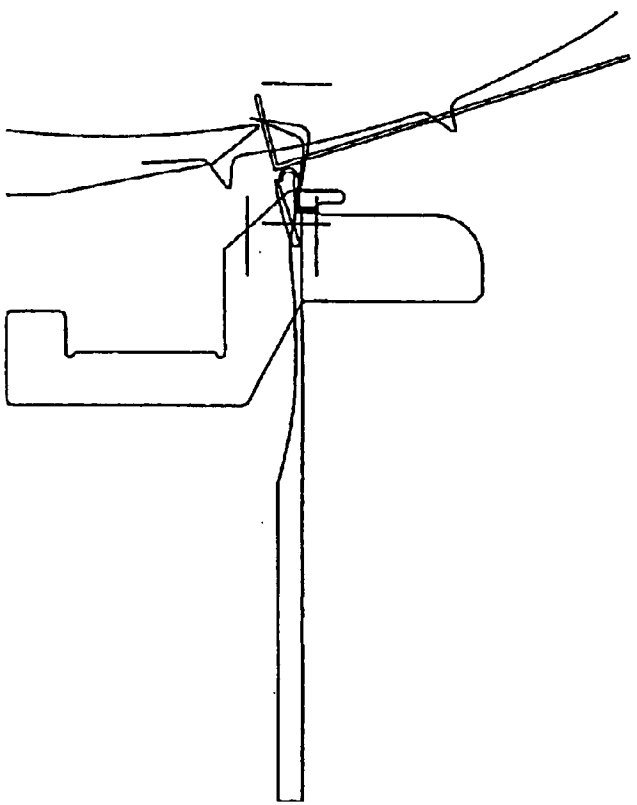
Figure 2E:
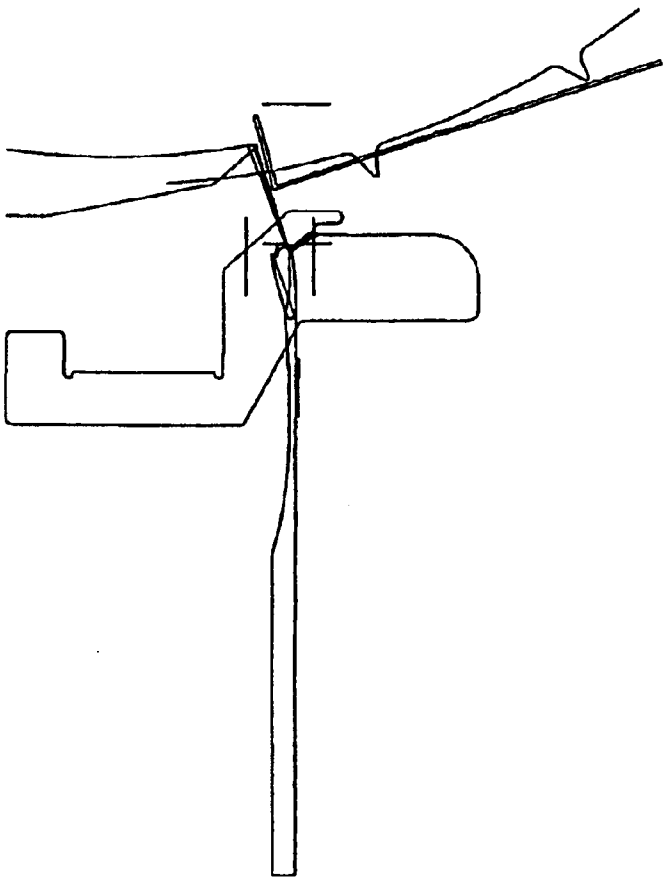
Figure 2H:
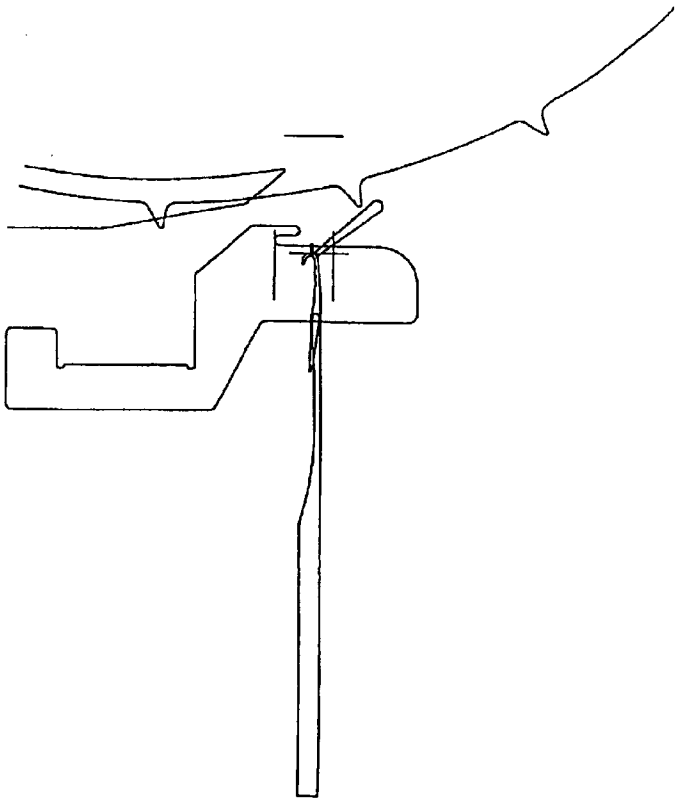
Figure 2G:
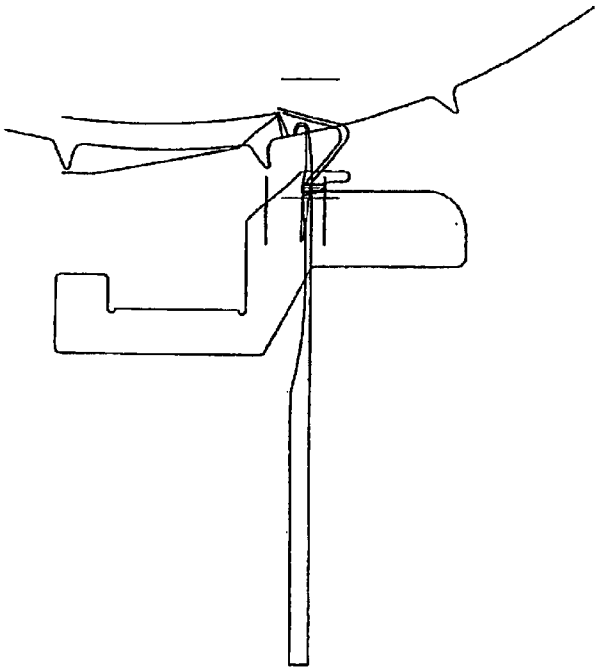

We find again the phase of FIG. 2*c*. The needles have pulled along the rest of the interfering fibres creating the actual small loop and bringing the two rows of mesh into proximity. At the same time, new interfering fibres have been pulled along, thus starting the formation of the next small loop.

Description of the Formation of a Meshed Product with a High Content of Interfering Fibres on the Reverse Side (Meshed Product with Small Loops)

The preparation of such a product is described in detail with the aid of FIGS. 3*a* to 3*h*, which break down the movement of the various phases of the method for obtaining such a product.

FIG. 3*a:*

The needles penetrate between the discs. As from this moment, the fibres will be accumulated behind the needles and form a pseudo-yarn (in which they will find themselves parallel again by virtue of the precise orientation of the web).

FIG. 3*b:*

The needles have started their descent and leave the discs. As from this moment, the fibres which will continue to be delivered by the discs (driven by a uniform rotational motion) will form the interfering fibres and feed the small loops.

FIG. 3*c:*

The needles have reached their bottom dead point. They "beat down" the pseudo-yarn between the beat-down plates in a rear position, thus forming a mesh. They have pulled along with it the interfering fibres over the length lc corresponding approximately to their travel and to the height of the small loop desired. These interfering fibres have not been pulled out of the web since the discs have, quite precisely, continued to turn so as to deliver exactly this quantity. The needles have therefore not experienced any force.

FIG. 3*d*

The needles are still at the bottom dead point. The plate is advancing to push the preceding meshes and thus avoid the needles penetrating them again on going up.

FIG. 3*e*

The needles have started their ascent. The plates, still in the advanced position, prevent the knitting from going up again with the needles. The discs have delivered a certain length of web which passes behind the axis of the needle.

FIG. 3*f*

Figure 3B:
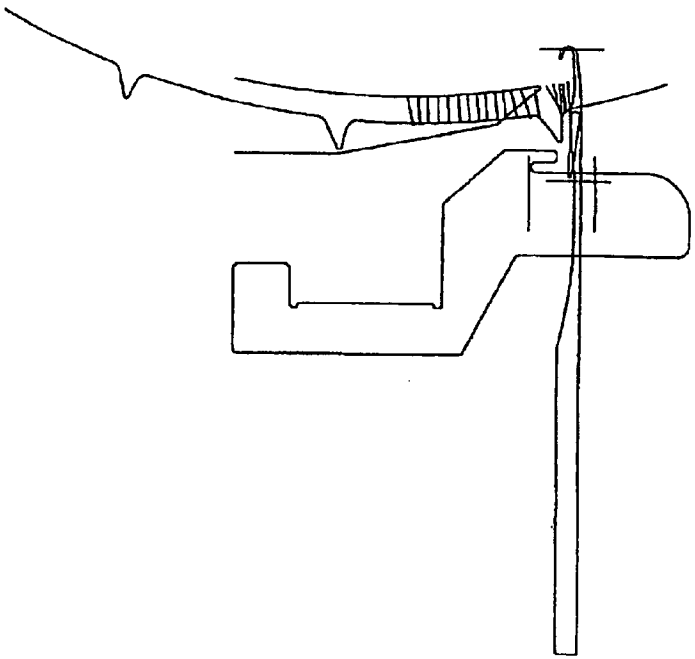
FIGS. 3*a* to 3*h* describe the complete cycle for making a meshed product according to a second preferred embodiment of the invention, which will be able to form a velvet product.
Figure 3A:
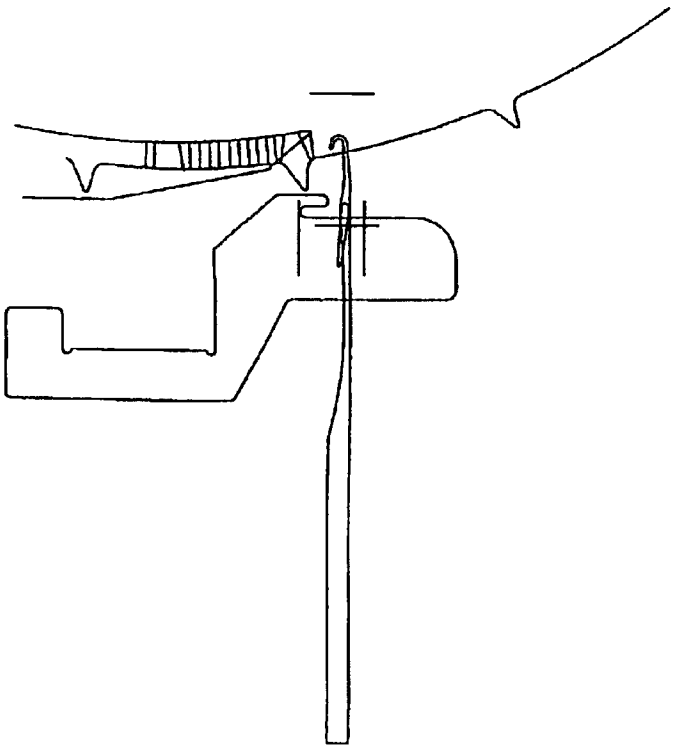
Figure 3D:
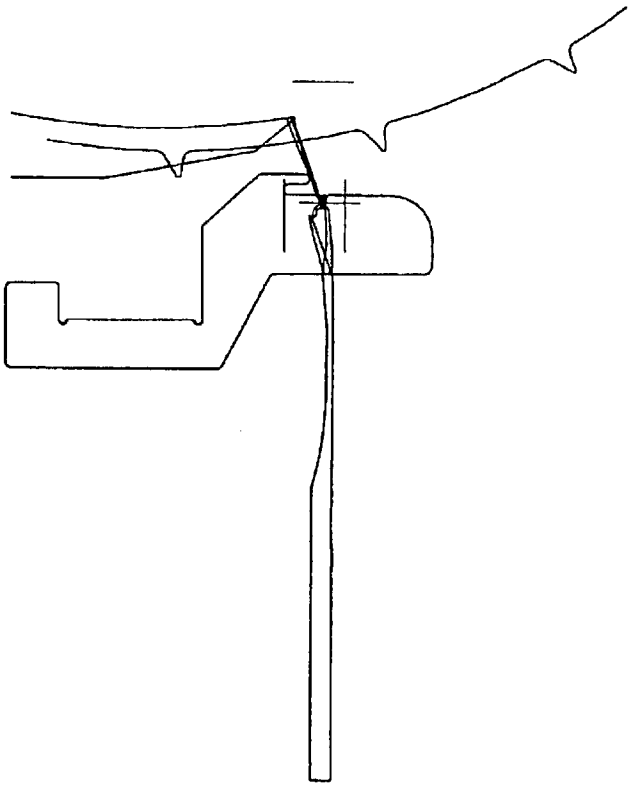

We find again the phase of FIG. 3*a*. The discs have delivered the complement necessary for the complete formation of the small loop. This part of the web will stagnate behind the needles, awaiting the descent of the needles.

FIG. 3*g*

We find again the phase of FIG. 3*b*. The new pseudo-yarn has been created. Among the fibres which form it are interfering fibres participating in the small loop whose formation we are in process of describing, and interfering fibres which will participate in the next small loop.

FIG. 3*h*

Figure 3C:
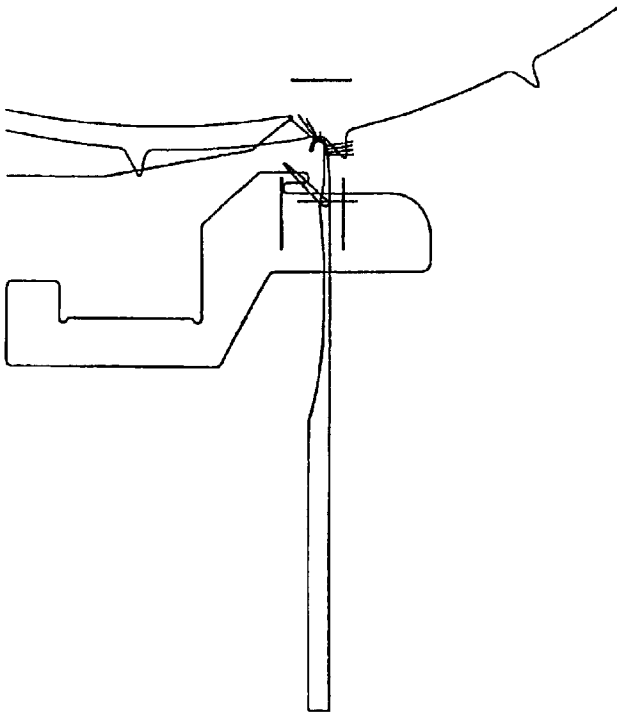
Figure 3F:
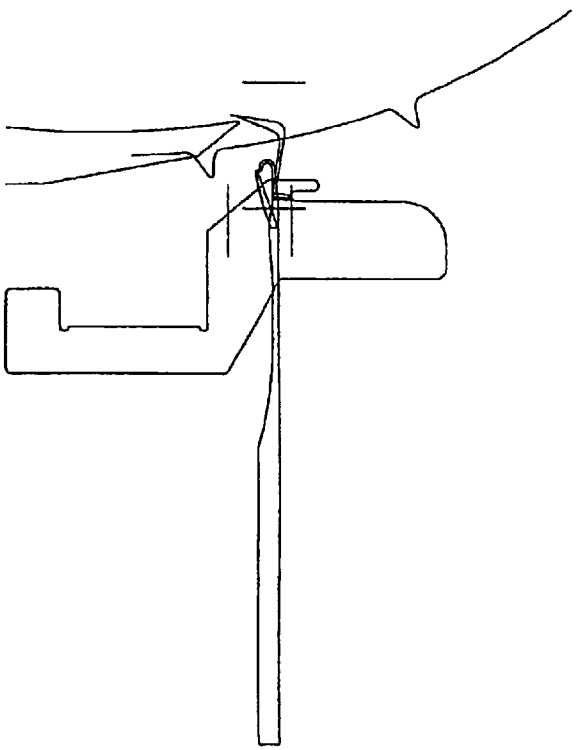
Figure 3E:
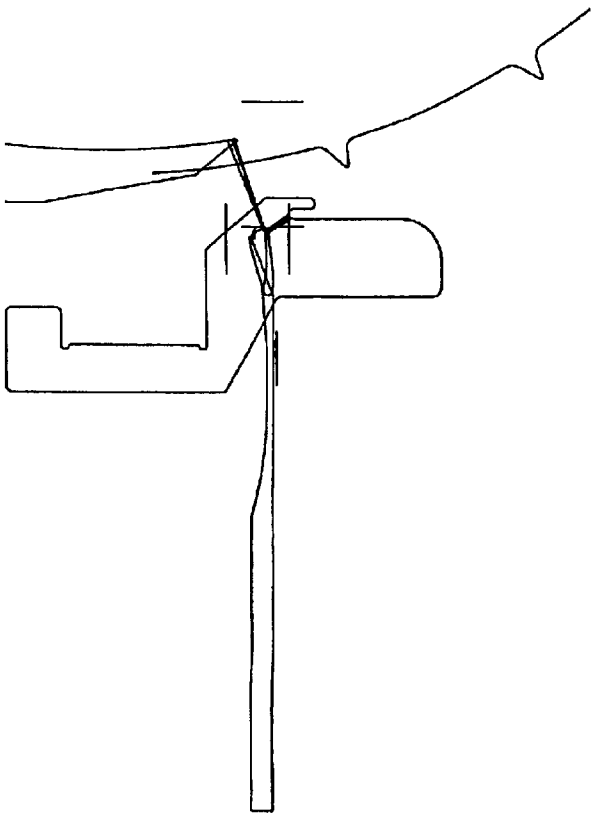
Figure 3H:
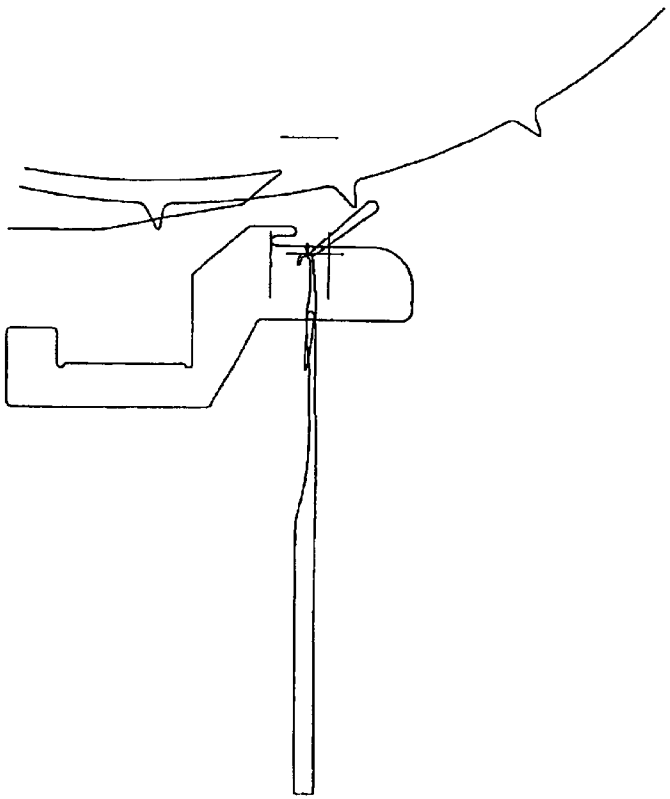
Figure 3G:
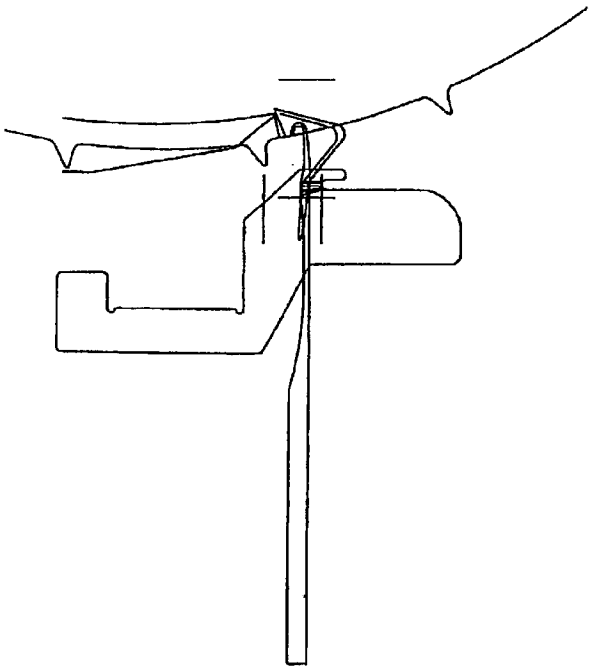

We find again the phase of FIG. 3*c*. The needles have pulled along the rest of the interfering fibres, creating the actual small loop and bringing the two rows of meshes into proximity. At the same time, new interfering fibres have been pulled along, thus starting the formation of the next small loop.

In conclusion, the method according to the present invention presents numerous advantages.

A first advantage is its simplicity of implementation, since the preparation of the small loops and therefore of the velvet is performed without using specific additional elements (such as a looping plate), unlike conventional yarn-based methods.

A second advantage is that this method is highly reliable and very safe to operate, since the needles do not experience any large forces either to form the basic stocking stitch serving for plane cohesion of the knitting or to form the small loops, unlike nonwoven methods for generating velvet such as needle-punching.

The preparation of velvet is not made more complex for all that, even in the case of very fine gauges (<1 mm). The method will therefore permit the easy preparation of very smooth velvet (for articles with a very low weight per unit area) or even for products of the "suede" type.

Another advantage of this method is that the cost of manufacture of the products is considerably reduced, given that the spinning operation will no longer be necessary for the manufacture of velvet, fleece-lined or fleece-type knitted articles. Furthermore the production rates of the looms deriving from the method can be very high, which improves the manufacturing efficiency.

In addition, by virtue of the method according to the invention, it is possible to use fibres that are difficult to spin or whose spinning cost is particularly high, such as certain natural fibres or microfibres.

Finally, the fact that the production line is compact permits the easy preparation of all kinds of mixtures of fibres, either above the card or by superimposing webs of card with a view to ensuring optimum cost or comfort or for aesthetic purposes.

What is claimed is:

1. A device for making meshed textile products from fibres and/or filaments moving along in the form of a web, comprising:

(a.) a set of identical spaced looping discs located on a common transverse axis alternating with a set of identical looping elements, each looping element including a prolongation in which is fitted a meshing needle which will receive crinkled pseudo-yarn of a certain length obtained by accumulation of said fibres and/or filaments, said looping discs having on their periphery regularly spaced teeth, the distance between two successive teeth being at least three times the height of said teeth, and (b.) a set of blocking means configured to block the fibres and/or filaments from continuing their course with said looping disc, each blocking means being arranged in the prolongation of the looping element and between two successive looping discs.

2. A device according to claim 1, wherein said blocking means are positively actuated.

3. A device according to claim 1, wherein the said looping discs have a rotational speed which is synchronized with that of said meshing needles so that, by means of a differential, the discs advance by an $X^{th}$ of a turn per needle movement, X being the number of teeth.

4. A method for making meshed textile products from fibres and/or filaments moving along in the form of a web, comprising:

(a.) transversely looping and drawing said fibres and/or filaments with the aid of an assembly formed by the interpenetration of a set of spaced identical looping disc located on a common transverse axis with a set of identical looping elements, said looping discs having on their perimeter a plurality of spaced teeth, (b.) accumulating said fibres and/or filaments in the form of at least one crinkled pseudo-yarn of a certain length in which said fibres and/or filaments are parallelized against a set of blocking means which prevents said fibres and/or filaments from continuing their course with said looping discs, (c.) transferring said pseudo-yarn over its entire length and simultaneously, directly into at least one eye of a set of meshing needles, and (d.) making a new row of meshes with the aid of said pseudo-yarn which has been transferred into said at least one eye of said set of meshing needles.

5. A method according to claim 4, wherein all of said meshing needles simultaneously perform the same movement to receive said pseudo-yarn obtained by accumulation of said fibres and/or filaments.

6. A method according to claim 4, wherein each blocking means is placed in the prolongation of a looping element and permits the passage of said pseudo-yarn created towards said at least one eye of said meshing needles when said meshing needles are in a top dead point position.

7. A method according to claim 4, wherein the spacing arrangement of said blocking means is varied to generate an adequate percentage of fibres serving as interfering fibres.

8. A method according to claim 4, wherein accumulation of said fibres and/or filaments can take place in the absence of any blocking means and will therefore take place over a distance comprised between two successive teeth, thereby creating surplus material on the reverse side of said product.

9. A device according to claim 2, wherein the rotational speed of said looping discs is synchronized with that of said meshing needles so that, by means of a differential, the discs advance by an $X^{th}$ of a turn per needle movement, X being the number of teeth.

10. A method according to claim 5, wherein each blocking means is placed in the prolongation of a looping element and permits the passage of the pseudo-yarn created towards said at least one eye of said meshing needles when said meshing needles are in a top dead point position.

11. A method according to claim 5, wherein the spacing arrangement of said blocking means is varied to generate an adequate percentage of fibres serving as interfering fibres.

12. A method according to claim 6, wherein the spacing arrangement of said blocking means is varied to generate an adequate percentage of fibres serving as interfering fibres.

13. A method according to claim 5, wherein accumulation of said fibres and/or filaments can take place in the absence of any blocking means and will therefore take place over a distance comprised between two successive teeth, thereby creating surplus material on the reverse side of said product.

14. A method according to claim 6, wherein accumulation of said fibres and/or filaments can take place in the absence of any blocking means and will therefore take place over a distance comprised between two successive teeth, thereby creating surplus material on the reverse side of said product.

15. A method according to claim 7, wherein accumulation of said fibres and/or filaments can take place in the absence of any blocking means and will therefore take place over a distance comprised between two successive teeth, thereby creating surplus material on the reverse side of said product.

* * * * *

UNITED STATES PATENT AND TRADEMARK OFFICE

CERTIFICATE OF CORRECTION

PATENT NO. : 6,918,164 B2
APPLICATION NO. : 10/483208
DATED : July 19, 2005
INVENTOR(S) : Bathelier It is certified that error appears in the above-identified patent and that said Letters Patent is hereby corrected as shown below:

Column 8:

Line 36, after "looping" delete "disc" and substitute --discs--.

Line 51, after "looping" delete "disc" and substitute --discs--.

Signed and Sealed this

Twenty-second Day of August, 2006

JON W. DUDAS
*Director of the United States Patent and Trademark Office*